United States Patent [19]

Kassal et al.

[11] Patent Number: 4,653,121

[45] Date of Patent: Mar. 31, 1987

[54] SKI STRAP SYSTEM

[76] Inventors: Randy Kassal, 2519 N. Ocean Blvd., Boca Raton, Fla. 33431; Jim Juday, 555 E. 7th South #1-C, Salt Lake City, Utah 84102

[21] Appl. No.: 685,720

[22] Filed: Dec. 24, 1984

[51] Int. Cl.[4] ..... A41D 19/00

[52] U.S. Cl. ..... 2/160; 2/161 A; 280/822

[58] Field of Search ..... 2/160, 158, 159, 161 A, 2/16; 280/821, 822

[56] References Cited

U.S. PATENT DOCUMENTS 3,170,703 2/1965 Marchand ..... 2/160 X 3,218,089 11/1965 Marchand ..... 2/160 X 3,232,632 2/1966 Lewis ..... 280/822

*Primary Examiner*—Werner H. Schroeder

*Assistant Examiner*—J. L. Olds

*Attorney, Agent, or Firm*—Eugene F. Malin

[57] ABSTRACT

Disclosed herein is a combination ski glove and ski strap. The glove has the hook portion of a fastener extending back on the backside thereof from the thumb and forefinger junction. The strap has the loop portion of the fastener materials are pressed together, the strap is affixed to the glove. If the ski pole to which the strap is connected becomes jammed, the strap is peeled away and no injury to the skier's hand or arm occurs.

4 Claims, 5 Drawing Figures

SKI STRAP SYSTEM

BACKGROUND OF THE INVENTION

This invention relates to a releasable ski pole strap and, more particularly, to the combination of a glove and ski pole strap in which the strap is affixed to the glove for normal use, but can be easily releasable in the event of an emergency, such as the ski pole becoming jammed in an object.

One of the most popular winter sports is skiing. In order to enjoy this sport it is necessary that the user have both skis and ski poles. The ski poles are used to assist the skier in skiing down the hill. In the event that a ski pole is lost during a ski run, there can be substantial danger to the skier because of the loss of control afforded by the poles. Thus, straps have been used with ski poles which can be wrapped around the wrist or glove of the skier to prevent the pole from becoming lost.

However, by using a conventional ski strap around the hand or glove, an additional danger is present. In certain instances it is possible for the bottom of the ski pole to become jammed between two rocks or trees or the like. If this happens while the skier is coming down the mountain at many tens of miles an hour, the jammed pole with the strap around the glove can cause serious injury to the skier's arm.

It would be desirable if a ski strap could be developed which is affixed to the pole and the skier's hand or glove so that the pole cannot be easily dislodged from the skier's immediate area, but which in certain emergency situations will automatically become dislodged to prevent serious injury to the skier's arm.

BRIEF DESCRIPTION OF THE INVENTION

In accordance with one aspect of this invention there is provided a ski glove and ski pole strap comprising a ski glove having a hand portion, a thumb pocket extending from a first part of the hand portion for receiving a thumb and at least one finger pocket extending from a second part of the hand portion for receiving at least one finger. There additionally is provided first fastener means affixed to the hand portion of the glove and extending back from between the first and second parts and a ski strap having one end affixable to a ski pole and second fastener means attached to an area of the strap remote from the one end. The first and second fastener means are affixable together by vertical pressure and are easily separable by peeling away the second fastener from the first fastener.

One preferred embodiment of the subject invention is hereafter described with specific reference being made to the following figures, in which:

DESCRIPTION OF THE PREFERRED EMBODIMENT

Figure 1:
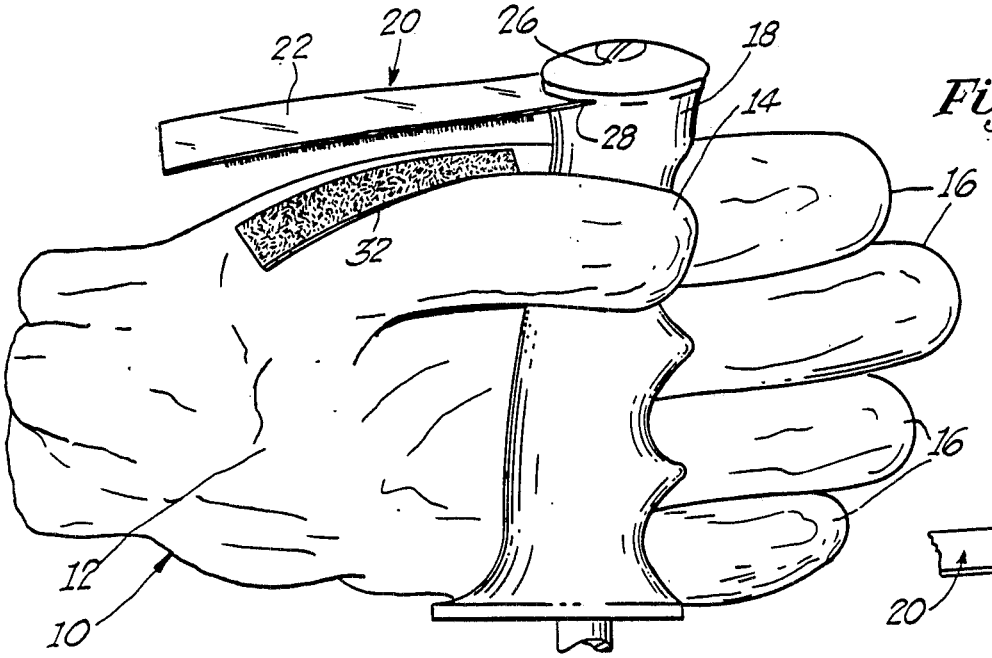
FIG. 1 shows the ski strap and glove combination.
Figure 3:
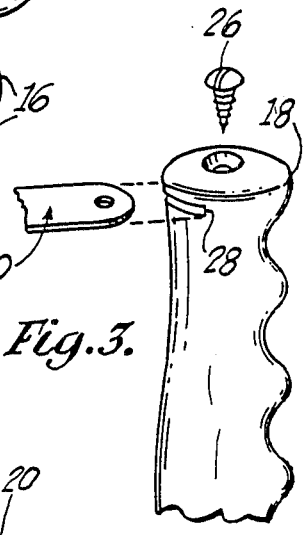
FIG. 3 shows how the ski strap is affixed to the ski poles.
Figure 2:
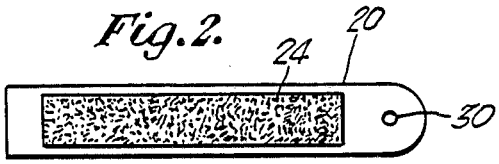
FIG. 2 shows the ski strap.

Referring now to FIGS. 1, 2 and 3, a ski glove 10 is shown which includes a hand portion 12, a thumb pocket 14 and a plurality of finger pockets 16. Glove 10 is adapted to being inserted over the human hand and the human thumb fits into pocket 14 and the fingers into pockets 16. It is also conceivable that finger pockets 16 can be replaced with a single pocket in a mitten arangement which receives all of the fingers of the hand.

A ski pole 18 is also shown in FIG. 1 which may be any conventional ski pole. A strap 20 is affixed to ski pole 18 in the conventional manner. Strap 20 may be composed of a vinyl or cloth base 22 and which has a fastener material 24 positioned on the bottom thereof. Fastener 24 may be the loop material portion of VELCRO. The VELCRO connector is an example of a hook and loop-releasable connecting means that may be used.

Referring to FIG. 3, ski strap 20 may be secured to ski pole 18 by removing the screw 26 from pole 18 and removing the conventional strap from the opening 28 therein. Ski strap 20 is then inserted through the opening 28 and screw 26 is replaced through hole 30 in strap 20. The underside of strap 20 is shown in FIG. 2 which also shows the portion of strap 20 beneath the top of ski pole 18.

Figure 4:
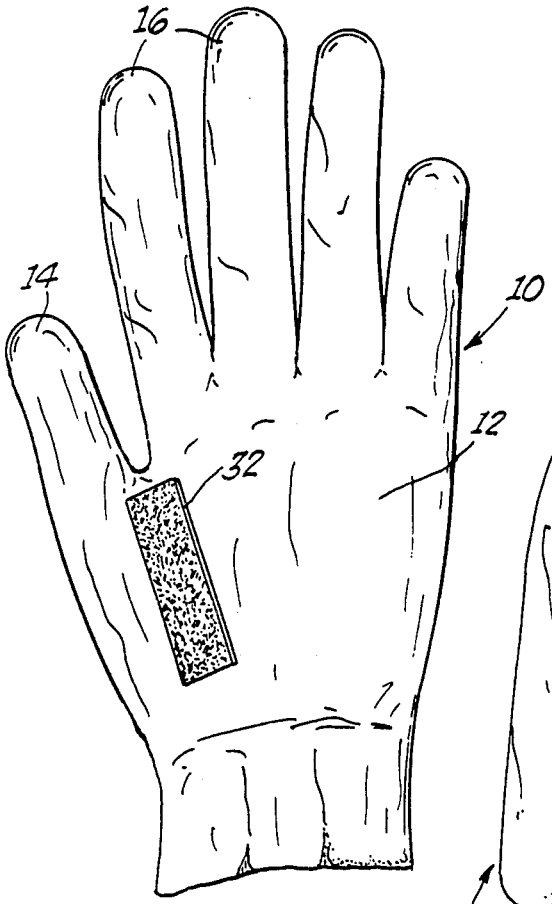
FIG. 4 shows a ski glove having a fastener means properly positioned thereon.

Referring now to FIGS. 1 and 4 a second fastener 32 is placed on the hand portion 12 of the glove and extending back from between the junction of thumb pocket 14 and the finger pockets 16. Fastener means 32 may be a material adapted to receive fastener 24 when vertical pressure is applied with fastener 24 physically on top of fastener 32. Upon the application of such vertical pressure the two fasteners remain affixed. However, fasteners 24 and 32 are of the type such that strap 20, including fastener 24, can be removed from fastener 32 by peeling away strap 20 from fastener 32. Fasteners 32 may be the hook portion of a Velcro fastener system. Fastener 24 may be positioned away from the end of base 22 to allow an area of base 22 to be gripped for removal from fastener 32.

Figure 5:
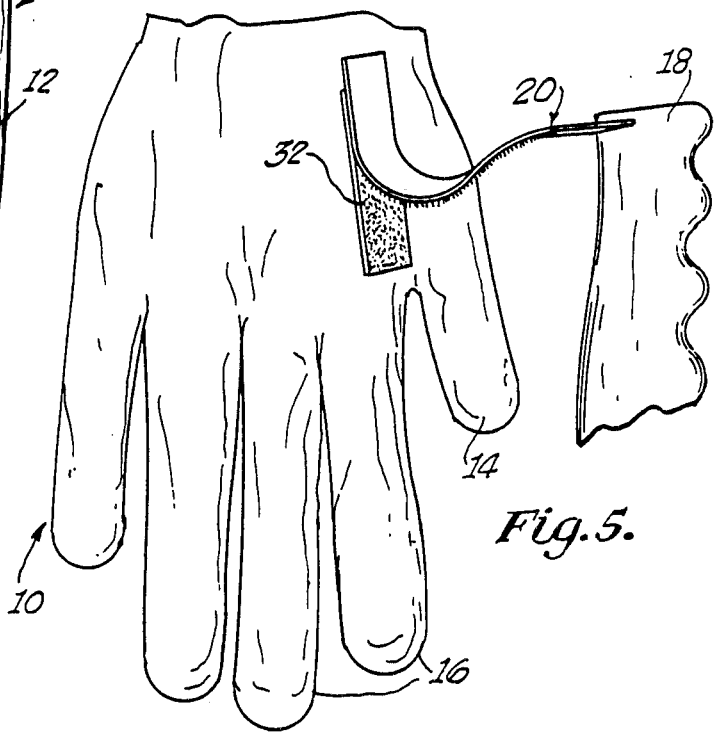
FIG. 5 shows the manner in which the ski pole is easily released from the ski glove in an emergency situation.

Referring now to FIG. 5, as a skier is traveling down a hill, if pole 18 becomes jammed between, for instance, two rocks the skier's hand will automatically move back with the pole as the remainder of the body continues down the hill on the skis. As the hand moves back, strap 20 is able to be peeled away from fastener 32 as shown in FIG. 5. As the body continues forward and the hand moves backward relative to the moving body, strap 20 is totally peeled away and the hand covered by glove 10 is free to move down the mountain with the remainder of the person's body. In this manner no injury will occurr to the skier's hand and arm as with conventional ski straps coupled around ski glove 10.

What is claimed is:

1. A system for separably fastening a user's ski pole handle and a user's ski glove together comprising:

a ski strap having a first end portion and a second end portion;

said first end portion being fixedly connected to said ski pole handle;

said second end portion including a first mating means that is separably fastenable to a second complementary mating means on said ski glove so that an opposing force between said ski pole handle and said ski glove will separate only said first mating means on said second end portion of said ski pole strap and said second complementary mating means on said ski glove.

2. A system for separably fastening a user's ski pole handle and a user's ski glove together comprising:

a ski strap system including a pole member and a glove member; said pole member having a first end portion and a second end portion;

said first end portion being fixedly connected to said ski pole handle;

said second end portion including a first mating means;

said glove member being fixedly connected to said ski glove and including a second complementary mating means; said second mating means is separably fastenable to a first mating means on said ski pole handle so that an opposing force between said ski pole handle and said ski glove will separate only said first mating means on said second end portion of said pole member and said second complementary mating means on said glove member.

3. A system as set forth in claim 1 wherein;

said first mating means and second complementary mating means are multidirectionally separable by varying releasing forces.

4. A system as set forth in claim 2 wherein said first mating means and second complementary mating means are multidirectionally separable by varying releasing forces.

* * * * *